United States Patent [19]

Frye, Sr. et al.

[11] 4,230,155

[45] Oct. 28, 1980

[54] TIMED ON-OFF SEQUENCE SHOWER VALVE

[76] Inventors: Joe G. Frye, Sr.; Teresa J. Frye, both of 7136 Deerwood Rd. N.W., Roanoke, Va. 24019

[21] Appl. No.: 37,112

[22] Filed: May 8, 1979

[51] Int. Cl.[3] ..... B05B 1/30

[52] U.S. Cl. ..... 137/624.22; 137/624.12; 239/68; 239/70

[58] Field of Search ..... 137/624.11, 624.14, 137/624.12, 624.22; 239/70, 68

[56] References Cited

U.S. PATENT DOCUMENTS

| | | | |
|---|---|---|---|
| 631,025 | 8/1899 | Merrill | 137/624.22 |
| 2,642,076 | 6/1953 | Tigert | 239/68 X |
| 4,130,135 | 12/1978 | Moore | 239/70 X |

*Primary Examiner*—Alan Cohan

*Attorney, Agent, or Firm*—Clarence A. O'Brien; Harvey B. Jacobson

[57] ABSTRACT

A water valve structure for disposition between the supply pipe and shower head of a bathroom shower. The valve structure includes an actuator shiftable between "on" and "off" positions and spring biased toward the "off" position. An actuator latch under the control of a water flow driven motor is also provided and an operator is provided for initiating movement of the actuator from the "off" position to the "on" position and for also winding a spring drive mechanism controlling a second latch operable to latch the actuator in the "off" position. Actuation of the operator winds the spring drive mechanism and retracts the second latch to allow spring biased movement of the valve structure actuator to the "on" position thereof in which it is latched by the first latch. The flow of water through the water valve structure actuates the motor and the motor, after a predetermined time interval, deactuates the first latch allowing movement of the valve structure actuator, by spring pressure, toward the "off" position in which it is latched by the second latch. Thereafter, the spring drive mechanism is automatically actuated and after a predetermined time interval, the second latch is rendered inoperative after which the water valve structure may again be shifted to the "on" position thus beginning the second cycle of operation of the water valve for a predetermined time interval for rinsing operations.

11 Claims, 7 Drawing Figures

Fig. 1
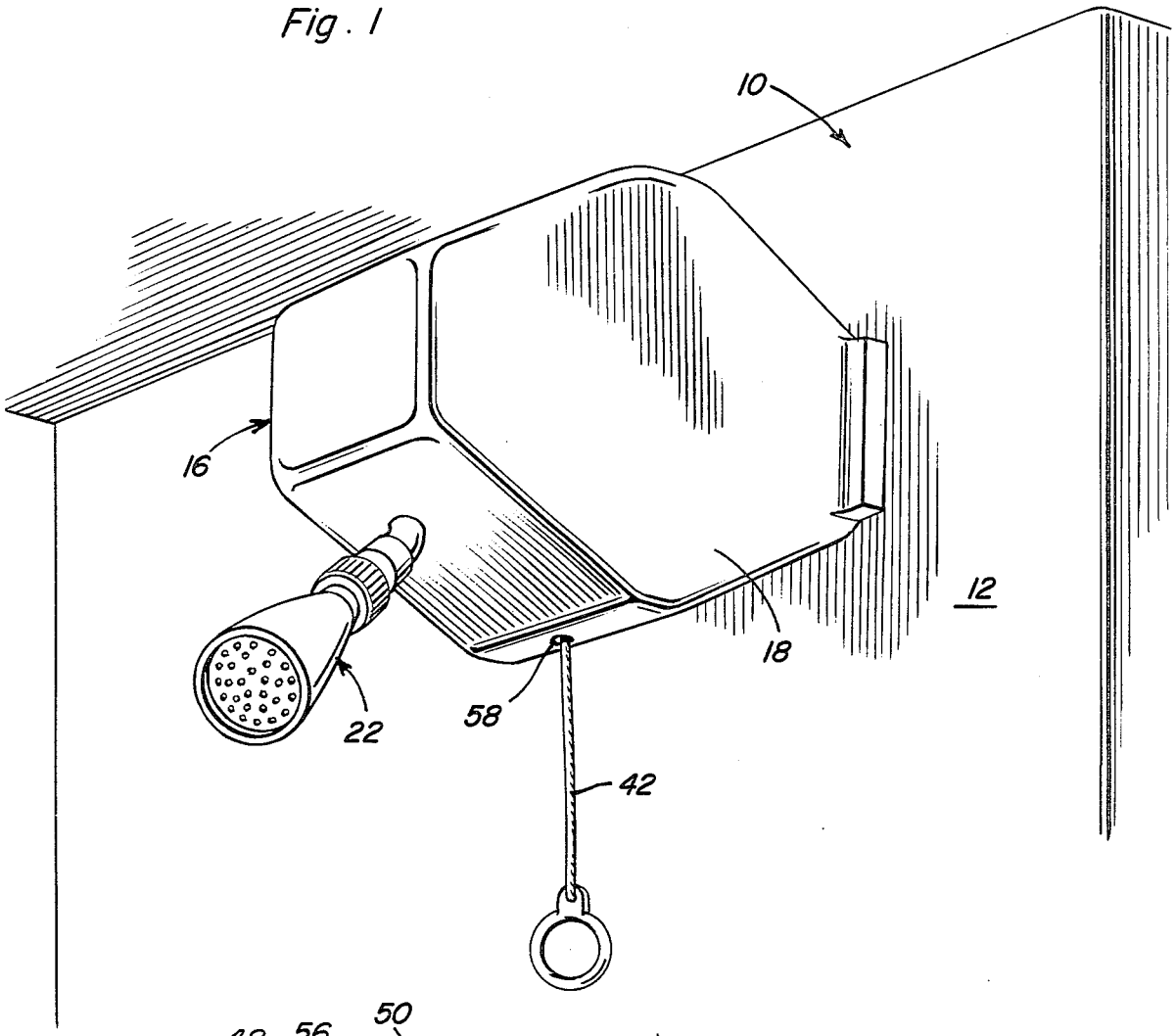
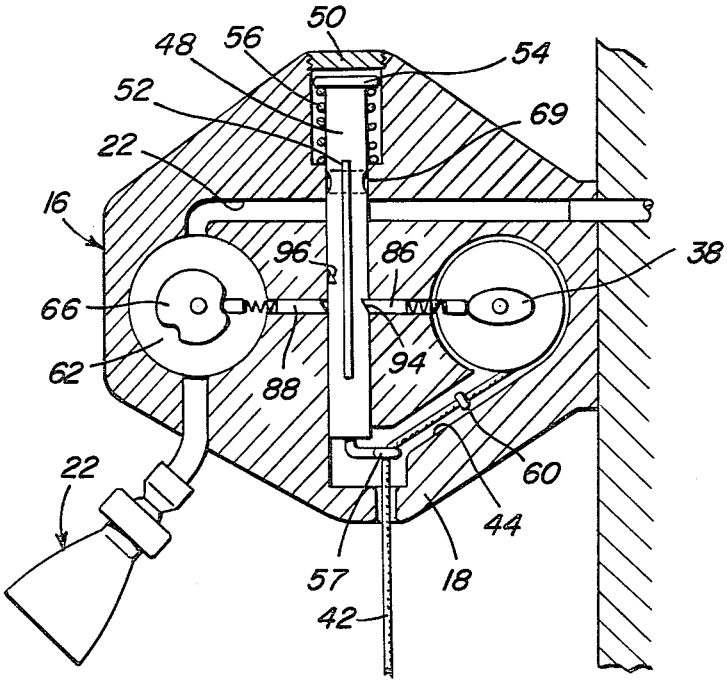
Fig. 7

TIMED ON-OFF SEQUENCE SHOWER VALVE

BACKGROUND OF THE INVENTION

There is at present an increasing move to conserve water utilized in domestic environments. While it is difficult to positively control the use of water in a kitchen and in a laundry room, various means have been provided for controlling the amount of water used in bathroom commodes. However, successful attempts at controlling the use of water in a bathroom shower heretofore have not been possible through the utilization of relatively simple construction.

Accordingly, a need exists for a suitable control for controlling the volume of water which may be used by persons taking a shower.

Examples of various shower water control mechanisms designed for different purposes and including some of the basic operational characteristics of the shower valve of the instant invention are disclosed in U.S. Pat. Nos. 1,163,732, 1,183,420, 1,825,355, 2,336,402, 2,635,691 and 4,042,984. However, these previously known devices are not suited for controlling, efficiently, the water discharged from a bathroom shower.

BRIEF DESCRIPTION OF THE INVENTION

The shower valve of the instant invention is constructed in a manner whereby initial actuation of the valve will allow shower water to flow therethrough for a predetermined time interval only, during which time interval a person taking the shower may become thoroughly wetted and begin washing. Then, the valve automatically terminates the flow of shower water for a predetermined time interval during which the person taking the shower may continue the washing operation. Only after the last mentioned time interval has been completed may the person taking the shower again actuate the control to cause water to flow through the shower valve for a second timed flow period during which the person may rinse.

The main object of this invention is to provide a shower valve which will be operative only to allow an initial flow of water for a predetermined time and which will then cut off the flow of water for a predetermined interval before allowing the valve to be again actuated by the operator of the shower for a second predetermined water flow interval during which the person may perform rinsing operations.

Another object of this invention is to provide a shower valve in accordance with the preceding objects which may be readily installed and actuated even by inexperienced persons.

Still another object of this invention is to provide a shower valve which will be adapted for use in substantially all shower stalls and shower and tub combination stalls.

A final object of this invention to be specifically enumerated herein is to provide a shower valve in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the shower valve of the instant invention;

FIG. 7 is a sectional view similar to FIG. 2, but with various shiftable internal parts in different positions.

DETAILED DESCRIPTION OF THE INVENTION

Figure 2:
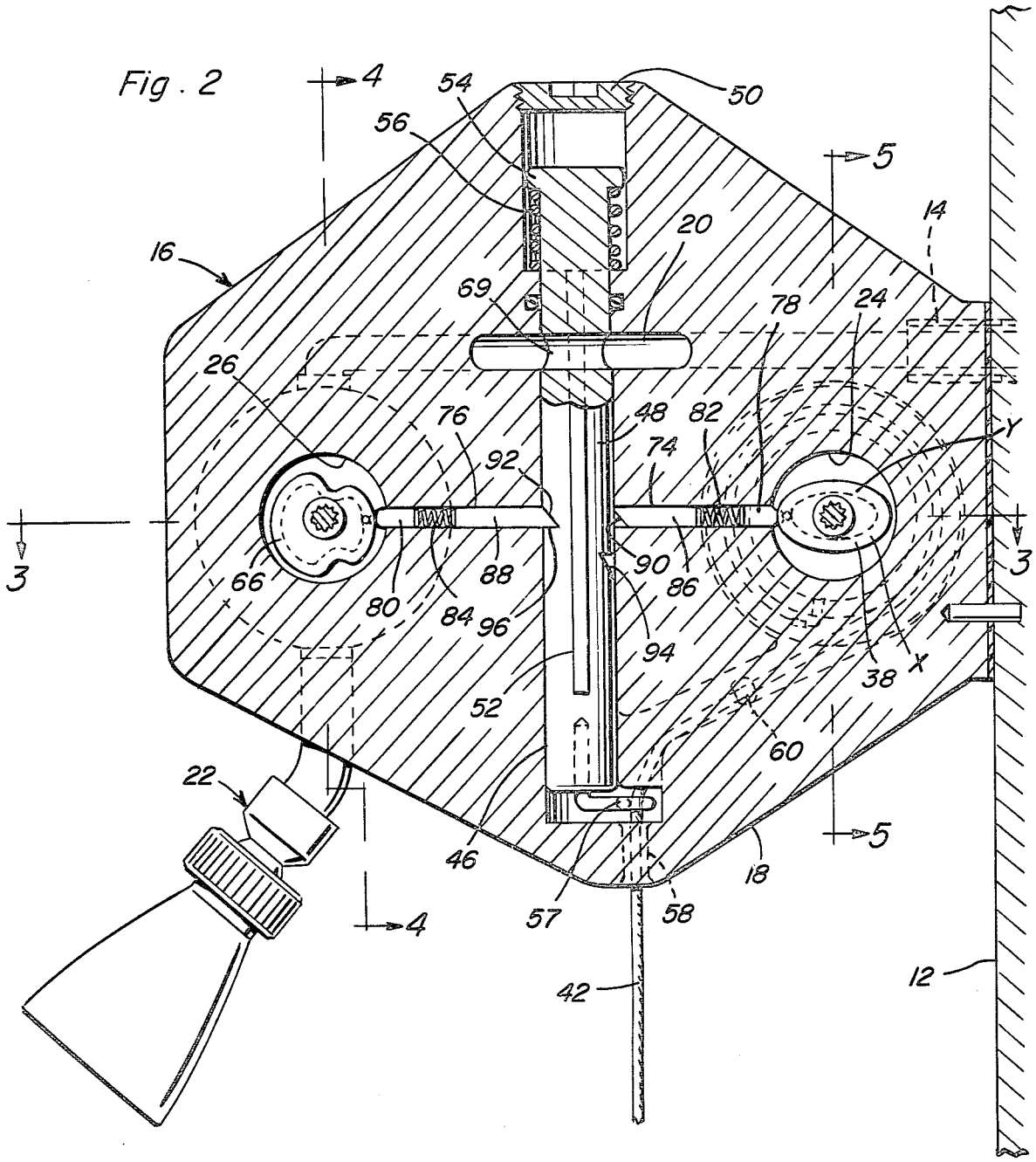
FIG. 2 is an enlarged fragmentary vertical sectional view taken substantially upon a plane passing through the central portion of the shower valve.
Figure 6:
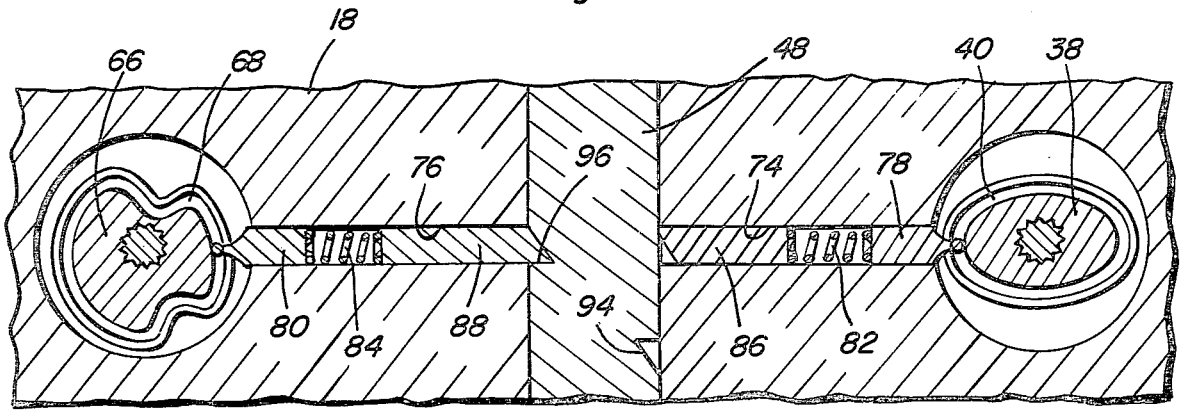
FIG. 6 is an enlarged fragmentary vertical sectional view illustrating the operative association between the water motor driven and clockwork motor driven cams and the pull-type valve actuator.
Figure 3:
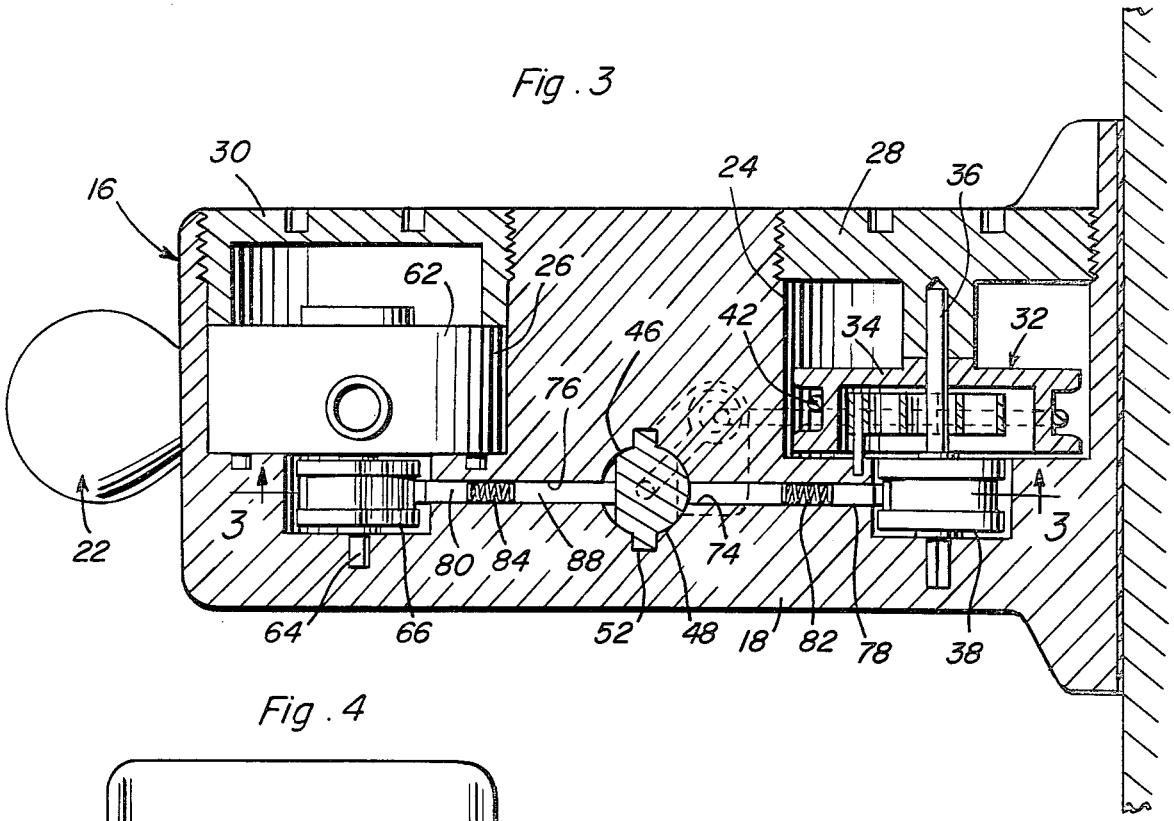
FIG. 3 is a horizontal sectional view taken substantially upon the plane indicated by the section line 3—3 of FIG. 2.
Figure 4:
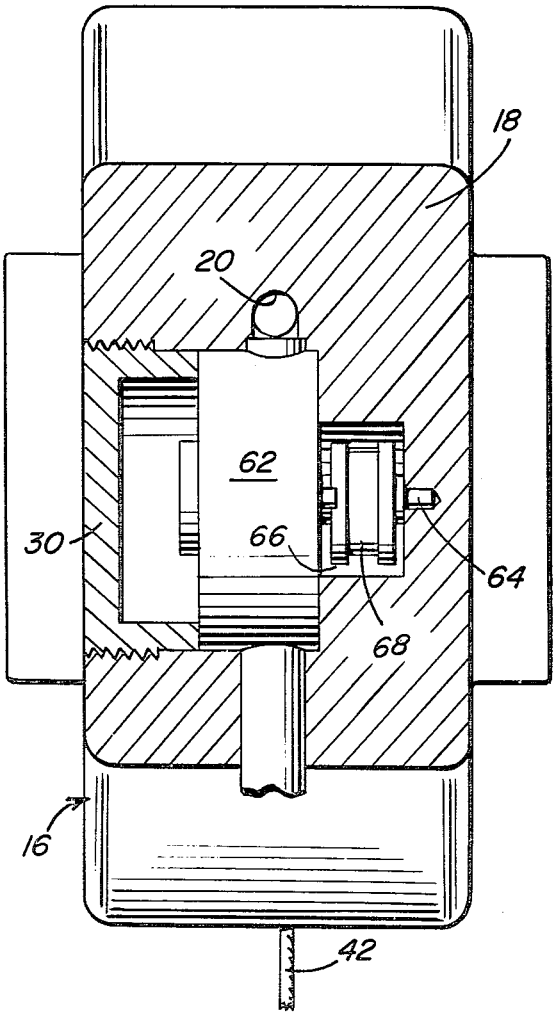
FIG. 4 is a vertical sectional view taken substantially upon the plane indicated by the section line 4—4 of FIG. 2.
Figure 5:
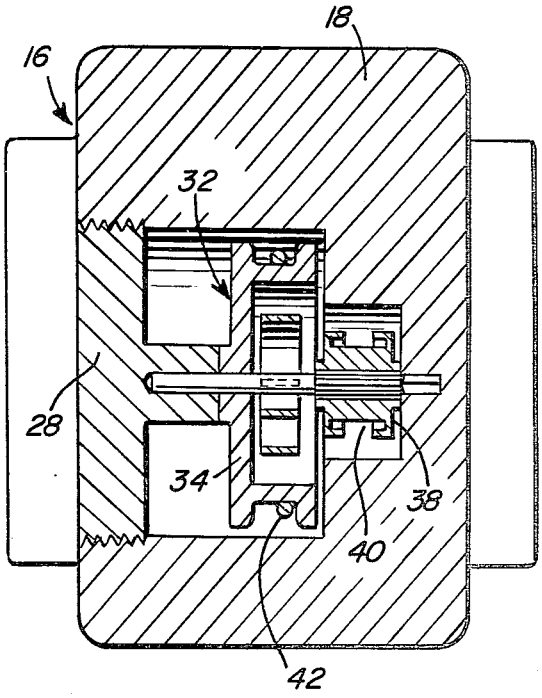
FIG. 5 is a vertical sectional view taken substantially upon the plane indicated by the section line 5—5 of FIG. 2.

Referring now more specifically to the drawings, the numeral 10 generally designates a shower stall including a wall 12 through which a water supply pipe 14 projects. The valve structure of the instant invention is referred to in general by the reference numeral 16 and includes a housing 18 supported from the wall 12 in any convenient manner and including a water passage 20 therethrough having its inlet end communicated with the water supply pipe 14. The outlet end of the passage 20 has a conventional shower head referred to in general by the reference numeral 22 operatively associated therewith.

The housing 18 includes first and second cavities 24 and 26 formed therein closed by removable plugs 28 and 30 and the cavity 24 removably houses a spring motor assembly referred to in general by the reference numeral 32 including a rotatable winding spool 34 and a rotatable output shaft 36. A cam 38 including a cam track 40 is mounted on the output shaft 36 for rotation therewith and an elongated flexible pull string 42 is wound on the winding spool 34 and extends through a passageway 44 communicating the inner portion of the cavity 24 receiving the cam 38 and a vertical passage 46 in the housing 18 in which a vertically reciprocal elongated valve actuator 48 is slidably mounted. The upper end of the vertical passage 46 is closed by means of a threaded plug 50 and is diametrically enlarged. The actuator 48 includes opposite side longitudinal splines 52 which are keyed to the housing 18 to prevent rotation of the actuator 48 in the vertical passage 46 and the actuator 48 includes a diametrically enlarged head 54 on its upper end beneath which a compression spring 56 is disposed for yieldingly biasing the actuator 48 upwardly in the passage 46.

The lower end of the actuator 48 includes an anchor eye 57 supported therefrom through which the string 42 extends and the lower end of the passage 46 opens through the bottom of the housing 18 via a small diameter passage 58 through which the string 42 is snugly slidably received. The string 42 includes an enlarged abutment 60 thereon of a size which will not pass through the eye 56.

The cavity 26 has a water driven motor 62 disposed therein and serially connected in the passage 20. The motor 62 includes a rotatable output shaft 64 upon which a cam 66 including a cam track 68 is defined. The passage 20 opens into the passage 46 and the actuator 48 includes a diametric passage 69 formed therethrough communicating those portions of the passage 20 on opposite sides of the passage 46 when the actuator 48 is disposed in the lower position thereof illustrated in FIG. 2 of the drawings.

Follower passages 74 and 76 communicate the inner portions of the cavities 24 and 26 with the passage 46 and followers 78 and 80 are disposed in the remote ends of the passages 74 and 76 opening into the cavities 24 and 26 and include portions engaged in the cam tracks 40 and 68.

Combined compression and pull strings 82 and 84 are disposed in the passages 74 and 76 on the adjacent sides of the followers 78 and 80 and are secured to the latter. First and second latch pins 86 and 88 are disposed in the passages 74 and 76 on the adjacent sides of the springs 82 and 84 and are secured to the latter. The pins 86 and 88 include beveled ends 90 and 92 engageable in notches 94 and 96 formed in the actuator 48.

In operation, the string 42 is initially pulled downwardly whereupon the cam 38 is turned so that the follower 78 is engaged with position X on the cam. However, during movement of the cam 38 to an angular position with the follower 78 engaged with position X, the follower 78 is retracted away from the passage 46 and the latch pin 86 is withdrawn from the notch 94. Also, the actuator 48 is pulled downwardly by the abutment 60 abutting the eye 57 and the spring motor 32 is wound as a result of clockwise rotation of the winding spool 34.

When the actuator 48 is pulled to the lower on position thereof illustrated in FIG. 2 against the biasing action of the compression spring 56, the passage 69 is registered with the portions of the passage 20 on opposite sides of the passage 46 thus enabling the flow of water through the passage 20, the motor 62 and the shower head 22. At the same time the actuator 48 is pulled to its lowest position, the latch pin 88, under the biasing action of the spring 84, seats in the notch 96 to thus latch the actuator 48 in the on position.

As water continues to flow through the passage 20 and the motor 62, the cam 66 is slowly rotated until the follower 80 engages one of the inwardly displaced portions of the cam track 68. At this time continued rotation of the cam 66 will cause the follower 80 to be pulled to the left as viewed in FIG. 2 of the drawings and the latch pin 88 to be withdrawn from the notch 96. This will allow the actuator 48 to be displaced upwardly under the biasing action of the spring 56 to the off position thereof illustrated in FIG. 7 with the passage 69 spaced above the adjacent portions of the passage 20 and the pin 86 aligned with the notch 94. At this time, the pin 86 seats in the notch 94 and the pressure of the spring 82 is reduced whereby the motor assembly 32 has sufficient power to pass the lobe of the cam 38 upon which position X is defined pass the follower 78. The rotation of the output shaft 36 of the motor 32 is slow and the cam slowly rotates until the follower 78 is positioned at position Y. As the cam 38 approaches a position with the follower 78 disposed at Y, the follower 78 is retracted away from the passage 46 sufficiently to enable the spring 82 to retract the pin 86 from the notch 94. During rotation of the cam 38, the string 42 is rewound and as soon as the pin 86 has been withdrawn from the notch 94 the period of non-use of the valve structure 16 will be terminated and the string 42 may again be pulled downwardly to downwardly shift the actuator 48 to the on position thereof illustrated in FIG. 2. This again enables water to flow through the passages 20 and 69 for the rinsing operation of a person using the shower.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A shower valve assembly including a housing defining a water flow passage therethrough including inlet and outlet ends for communication with a water supply pipe and a shower head, a valve member supported from said housing for shifting between open and closed positions opening and closing said passage intermediate its opposite ends, said assembly including first and second latch means operative to releasably latch said valve member in said open and closed positions, respectively, water flow driven motor means operatively associated with said flow passage downstream from said valve member for releasing said first latch responsive to a predetermined amount of water flow through said passage, means yieldingly biasing said valve member toward said closed position, an actuator for said valve assembly shiftable between on and off positions, said valve assembly including selectively operable timer means, said timer means being operatively associated with said second latch for releasing the latter after a predetermined time subsequent to initial actuation of said timer means.

2. The combination of claim 1 wherein said second latch, valve member and timer means include coacting structure operative to automatically actuate said timer responsive to said second latch latching said valve member in said closed position thereof.

3. The combination of claim 1 wherein said timer means is of the spring wound and driven type, said actuator being operatively connected to said timer for winding the spring thereof responsive to said actuator being shifted to said on position.

4. The combination of claim 3 wherein said timer means and said second latch means include means timer operation delay means operative to delay operation of said timer means subsequent to actuation of said timer means until said second latch means latches said valve member in said off position.

5. The combination of claim 4 wherein said second latch, valve member and timer means include coacting structure operative to automatically actuate said timer responsive to said second latch latching said valve member in said closed position thereof.

6. A shower valve assembly including a housing defining a water flow passage therethrough including inlet and outlet ends for communication with a water supply pipe and a shower head, and said shower valve assembly including a manually operable actuator shiftable between on and off positions, and water flow control means operative, upon shifting of said actuator to said on position, to sequentially allow a predetermined volume of water flow through said water flow passage and thereafter automatically terminate water flow through said water flow passage, said water flow control means also including means operative to return said actuator toward said off position subsequent to termination of said water flow and prevent reshifting of said actuator to said on position for a predetermined time interval.

7. The combination of claim 6 wherein said valve assembly includes a valve member shiftable between open and closed positions and yieldingly biased toward said closed position, said valve assembly further including first and second latch means operative to releasably latch said valve member in said open and closed positions, respectively, said water control means including means operative to actuate said first latch means automatically in response to shifting of said valve member to said open position.

8. The combination of claim 7 wherein said valve assembly includes selectively operable timer means, said timer means being operatively associated with said second latch for releasing the latter after a predetermined time subsequent to initial actuation of said timer means.

9. The combination of claim 8 wherein said second latch, valve member and timer means include coacting structure operative to automatically actuate said timer responsive to said second latch latching said valve member in said closed position thereof.

10. The combination of claim 9 wherein said timer means is of the spring wound and driven type, said actuator being operatively connected to said timer for winding the spring thereof responsive to said actuator being shifted to said on position.

11. The combination of claim 10 wherein said timer means and said second latch means include means timer operation delay means operative to delay operation of said timer means subsequent to actuation of said timer means until said second latch means latches said valve member in said off position.

* * * * *